US005407021A

United States Patent [19]

Kane et al.

[11] Patent Number: 5,407,021

[45] Date of Patent: Apr. 18, 1995

[54] DOWN-THE-HOLE HAMMER DRILL HAVING REVERSE CIRCULATION

[75] Inventors: Robert F. Kane, Harris; Matthew Shofner, Fort Bend; Faisal J. Yousef; Kenneth Ahlhorn, both of Harris, all of Tex.

[73] Assignee: Sandvik Rock Tools, Inc., Bristol, Va.

[21] Appl. No.: 44,204

[22] Filed: Apr. 8, 1993

[51] Int. Cl.[6] ..... E21B 4/14

[52] U.S. Cl. ..... 175/296; 175/306; 175/418

[58] Field of Search ..... 175/296, 306, 100, 405, 175/417, 418, 419

[56] References Cited

U.S. PATENT DOCUMENTS

| | | | |
|---|---|---|---|
| 3,951,220 | 4/1976 | Phillips, Jr. et al. | 175/393 |
| 4,321,974 | 3/1982 | Klemm | 175/92 |
| 4,527,641 | 7/1985 | Klemm | 175/92 |
| 4,705,118 | 11/1987 | Ennis | 175/65 |
| 4,819,746 | 4/1989 | Brown et al. | 175/296 |
| 4,921,056 | 5/1990 | Ennis | 175/92 |
| 4,940,097 | 7/1990 | Martini | 175/417 X |
| 5,139,096 | 8/1992 | Lister | 175/92 |

FOREIGN PATENT DOCUMENTS

| | | |
|---|---|---|
| A52436/86 | 7/1987 | Australia . |
| 334834 | 5/1919 | Germany . |

*Primary Examiner*—Terry Lee Melius

*Attorney, Agent, or Firm*—Burns, Doane, Swecker & Mathis

[57] ABSTRACT

A down-the-hole hammer drill having a reverse circulation system which conducts pressurized air downwardly to a lower cutting face of a drill bit. The air travels across the cutting face and upwardly through a central exhaust passage. The air is conducted to the cutting face through longitudinal and lateral passages in the bit which are kept isolated from the environment surrounding the bit so that no appreciable amount of pressurized air can escape, and so that the passages do not become clogged with dirt. The drill bit comprises upper and lower pieces. Upper sections of the longitudinal passages are formed in the upper piece, and lower sections of the longitudinal passages are formed in the lower piece.

22 Claims, 2 Drawing Sheets

DOWN-THE-HOLE HAMMER DRILL HAVING REVERSE CIRCULATION

BACKGROUND OF THE INVENTION

The present invention relates to a down-the-hole hammer drill having a reverse circulation system and to a drill bit for such a drill.

A down-the-hole hammer drill employs a drill pipe to which a drill bit is mounted, and wherein a reciprocating piston is situated in a drill casing immediately above the bit for imparting repeated blows to the bit.

A reverse circulation system involves the downward circulation of a flushing medium, such as air, to a front cutting face of the bit, whereupon the air flows laterally across the putting face and eventually up through a center passage in the bit and hammer to the ground surface. Cuttings become entrained within the air as the air passes across the cutting face of the bit and are conducted to the surface along with the air and are analyzed for mineral content. Also, the air serves to cool and flush cutter elements mounted in the cutting face.

Prior art drills of that type are disclosed, for example, in U.S. Pat. No. 4,321,974 issued Mar. 30, 1982 and U.S. Pat. No. 4,819,746 issued Apr. 11, 1989. That drill includes a drill bit mounted within a driver sub, the latter serving to transmit rotation from a drill string to the drill bit. A reciprocating piston is situated immediately above the bit and is reciprocated by an air flow introduced through the drill string. Air exhausted from the piston is conducted downwardly through a space formed between the drill bit and a driver sub. The driver sub is enlarged conically at its lower end to encircle a rear shoulder of the drill bit. Air is able to leak out between that shoulder and the enlarged conical end. In an attempt to resist the escape of air upwardly through an annular gap formed between the driver sub and a wall of the hole being drilled, the bit is provided with longitudinal bores and transverse bores. The longitudinal bores include air inlets located at a rear shoulder of the bit, and air outlets opening into the cutting face. The lateral bores include air inlets opening at the rear shoulder, and air outlets communicating with the center passage at a location above the cutting face. The air exiting the longitudinal and lateral bores is intended to create a suction for resisting the escape of air upwardly through the annular gap.

Notwithstanding the presence of the longitudinal and lateral bores, some air may still escape upwardly through the annular gap. Moreover, there exists the possibility of the inlets of the bores becoming clogged with dirt if the bores are not effectively isolated from the surrounding environment.

Another shortcoming associated with such drills involves difficulties in forming the fluid passages in the drill bit which can lead to undesirably high manufacturing costs.

It would be desirable to provide a hammer drill which alleviates the above-described problems and yet which can be economically manufactured.

SUMMARY OF THE INVENTION

The present invention relates to a down-the-hole hammer drill having a reverse circulation system. The drill includes a cylindrical case, and a driver sub mounted in the case. A piston is vertically reciprocally mounted in the case to be reciprocated by pressurized fluid. A drill bit is mounted in the driver sub beneath the piston for being impacted thereby. The drill bit is connected to the driver sub for rotation therewith and is downwardly movable relative to the driver sub from a drilling condition to a drop-open condition. The drill bit includes upper and lower pieces. The lower piece includes a recess in which a lower end of the upper piece is fixedly interconnected. A lower cutting face is formed in the lower piece. The drill bit further includes a vertical internal exhaust passage formed in the upper piece in communication with the cutting face and extending upwardly to an upper end of the drill bit. A plurality of longitudinal passages are provided, each having upper and lower sections, the upper section being formed in the upper piece and including an inlet. The lower section extends to the cutting face. The longitudinal passages are arranged to receive pressurized fluid and conduct that fluid to the cutting face and into the internal exhaust passage. The drill bit includes an outer surface formed on the upper piece in surrounding relationship to the upper sections of the longitudinal passages and being disposed in guiding relationship with an inner periphery of the driver sub in both the drilling condition and drop-open condition.

Preferably, a lateral passage communicates at least one of the longitudinal passages with the inner exhaust passage at a location above the cutting face for discharging some of the pressurized fluid into the inner exhaust passage at a location above the cutting face in order to assist in drawing fluid through the inner exhaust passage from the cutting face. The lateral passage is partially formed by the upper piece and partially by the lower piece.

The present invention also pertains to the drill bit per se.

BRIEF DESCRIPTION OF THE DRAWING

The objects and advantages of the invention will become apparent from the following detailed description of a preferred embodiment thereof in connection with the accompanying drawings in which like numerals designate like elements and in which.

DETAILED DESCRIPTION OF A PREFERRED EMBODIMENT OF THE INVENTION

Figure 1:
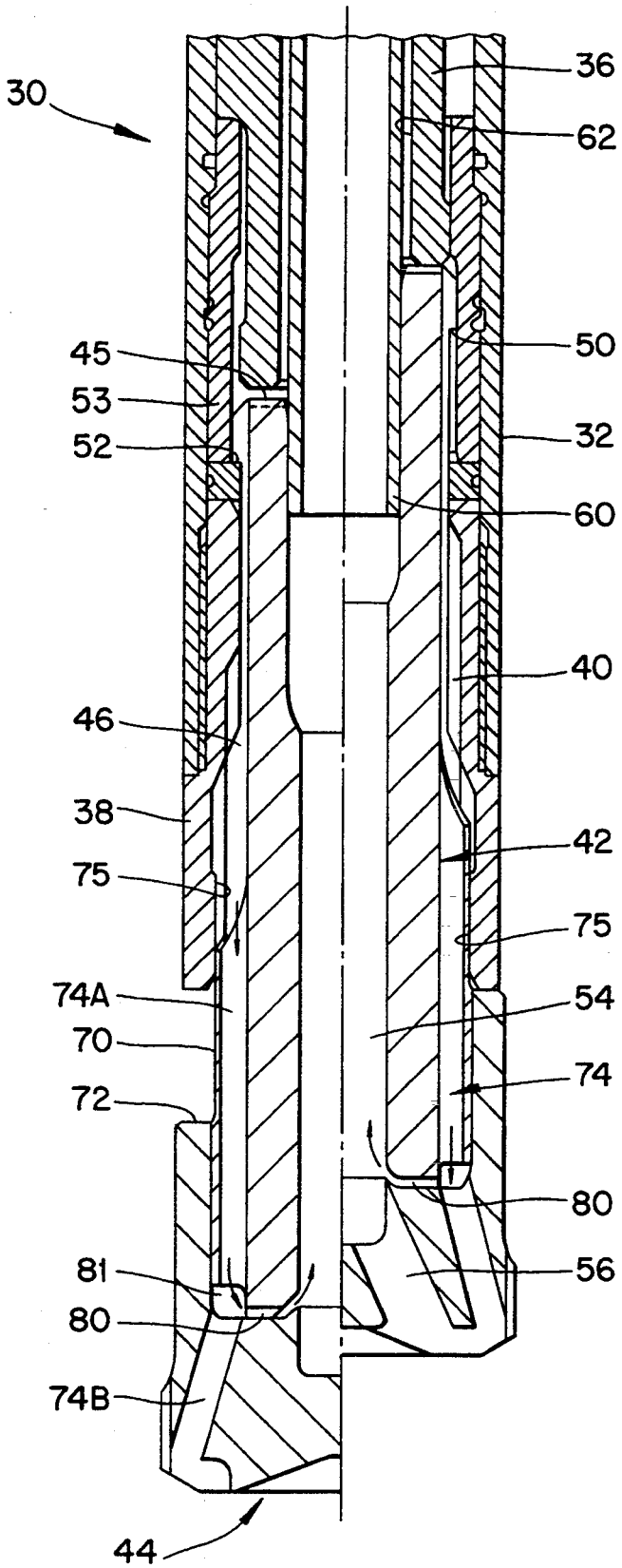
FIG. 1 is a longitudinal sectional view taken through a drill according to the present invention, with the left half of the figure depicting a drop-open condition of the drill, and the right half of the figure depicting a drilling condition of the drill.
Figure 4:
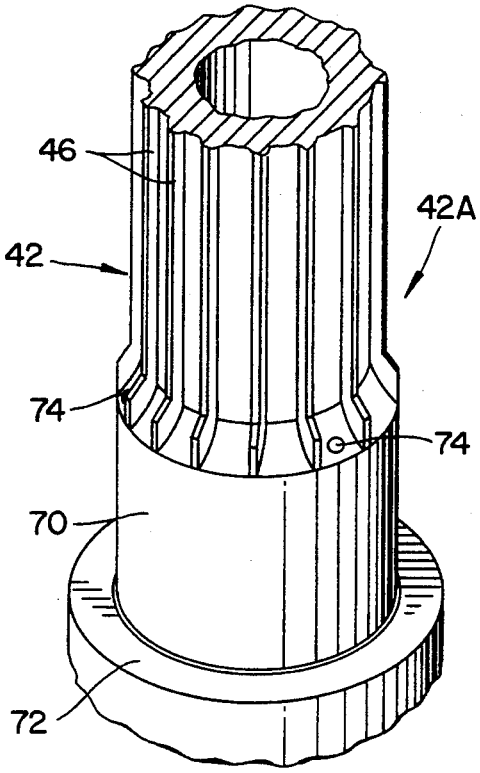
FIG. 4 is a fragmentary perspective view of a portion of the drill bit depicted in FIG. 2.
Figure 4:
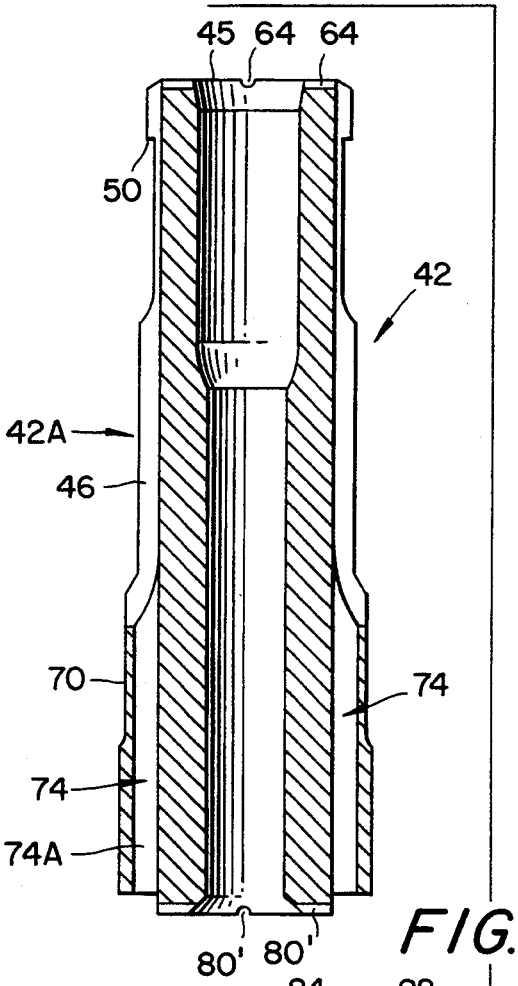

A down-the-hole hammer drill 30 having a reverse circulation system is depicted in FIGS. 1–4. The drill 30 includes a cylindrical case 32 which houses and guides a piston 36 for vertical reciprocation driven by pressurized fluid such as air in a conventional manner. An upper end of the case is connected to a drill string (not shown).

Threadedly secured in a lower end of the case 32 is a driver sub 38 which has internal splines 40 arranged in torque-transmitting relationship with a steel drill bit 42. The drill bit 42 projects downwardly past the driver sub 38 and includes a bottom or front cutting face 44 in which cutter elements are to be mounted. The bit includes a rear or top face 45 which is abutted by the piston, and a plurality of external splines 46 which slidably engage the internal splines 40 of the driver sub.

Rotation is transmitted to the case 32 by means of the drill string, and the bit 42 is thus driven in rotation by the driver sub 38 while being impacted by the piston 36. The case and driver sub are capable of up-and-down movement relative to the drill bit between an upper position shown in the left half of FIG. 1 (i.e., a drop open condition of the drill) and a lower position shown in the right half of FIG. 1 (i.e., a drilling condition of the drill).

At their upper ends the external splines 46 include annular radial shoulders 50 which is configured to rest upon an annular radial seat 52 which is interposed between a guide bushing 53 and the driver sub 38. In that way, the bit is held within the driver sub 38. An outer diameter of the shoulder closely approximates an internal diameter of the guide bushing 53, so that the upper end of the bit is supported and guided during vertical movement relative to the driver sub.

Figure 2:
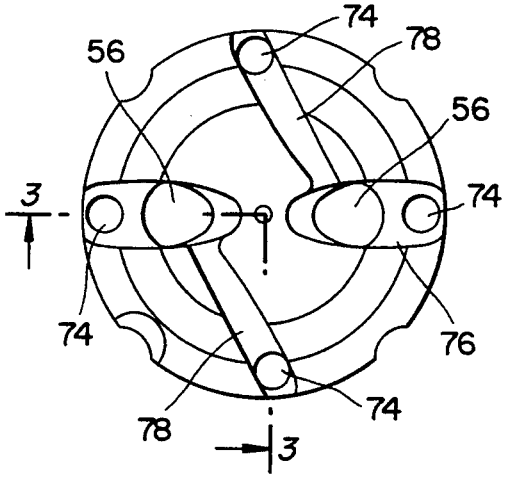
FIG. 2 is a bottom end view of the drill depicted in FIG. 1.

Extending upwardly through the center of the bit 42 is a central inner exhaust passage 54 which communicates at its lower end with a pair of exhaust holes 56 that open into the cutting face 44 (see FIG. 2).

A tube 60 fits into the upper end of the inner passage 54 and projects upwardly therefrom to loosely receive a through-bore 62 of the piston 36. In that fashion, the passage 54 remains in communication with the through-bore 62 of the piston during reciprocation of the latter, enabling the passage 54 to continuously communicate with the ground surface.

The upper end 45 of the bit 42 includes a plurality of radial slots 64 (see FIG. 3) to define radial passages which admit downwardly flowing exhaust air from the piston. That air, still under pressure, flows through gaps formed between the splines 40, 46. In that regard, the splines 46 of the drill bit are radially deeper than the splines 40 to ensure so that the gaps are sufficiently large to conduct ample air flow.

The lower ends of the splines 46 of the bit 42 are situated above the lower end of the driver sub in both the drilling and drop-open conditions of the drill, as shown in FIG. 1. The bit includes a cylindrical surface 70 extending downwardly from the lower ends of the splines to a radial outward shoulder 72 of the bit. The inner diameter of the lower end of the driver sub slidingly engages that cylindrical surface 70, and the end of the driver sub 38 abuts against the shoulder 72 in the drilling condition of the drill.

Similarly to the relationship between the outer diameter of the shoulders 50 and the inner diameter of the guide bushing 53, the outer diameter of the surface 70 closely approximates that of the inner cylindrical surface 75 of the lower end of the driver sub so that the sub supports and guides the bit during relative vertical movement therebetween. Although a perfect air seal is not established therebetween, there is effected a substantial resistance to the leakage of air and the entry of dirt. It will also be appreciated that the bit is effectively guided for vertical movement relative to the driver sub adjacent the upper and lower ends of the bit (i.e., recall that the outer diameter of the shoulders 50 of the bit is supported and guided by the inner diameter of the guide bushing 53), thereby preventing any wobbling of the bit.

Formed in the drill bit are a plurality of (e.g., eight) circumferentially spaced longitudinal passages 74 having upper inlet ends disposed between pairs of the splines 46. The longitudinal passages 74 are spaced radially inwardly from the cylindrical surface 70 and radially outwardly of the central exhaust passage 54. The passages 74 extend through the cutting face adjacent an outer periphery of the cutting face (see FIG. 2). A lower outlet end of each passage 74 communicates with one of the exhaust holes 56 by means of a channel 76 or 78 formed in the cutting face. In addition, at least some (e.g., four) of the longitudinal passages 74 communicate with the center passage 54 of the drill bit by means of lateral passages 80.

During a drilling operation, pressurized air which reciprocates the piston 36 is exhausted. That exhaust air is conducted downwardly through the gaps disposed between the splines 40, 46 and then flows into the longitudinal passages 74. Some of the air exits the longitudinal passages 74 at the cutting face and flows across the cutting face to cool and flush the cutting elements, and to cause cuttings to become entrained therein for upward travel through the center passage 54. The rest of the air exits the longitudinal passages 74 through the lateral passages 80 and is discharged into the central passage 54 in an upward direction to create a suction which aids in drawing cuttings through the exhaust holes 56.

No appreciable quantity of air leaks into the annular gap formed between the drill and the hole being drilled, because of the engagement between the inner diameter of the lower end of the driver sub and the cylindrical surface 70 of the bit. No appreciable leakage occurs even as the drill assumes a drop-open condition (see the left half of FIG. 1), because the engagement between the inner diameter of the driver sub and the surface 70 is maintained. Hence, virtually all of the pressurized exhaust air is available for flushing and cooling of the cutter elements, and/or the conveyance of cuttings.

Furthermore, the continuous engagement between the inner cylindrical surface 75 of the lower end of the driver sub and the cylindrical surface 70 prevents dirt from entering and clogging the longitudinal and lateral passages 74, 80 in both the drilling and drop-open conditions.

The bit 42 is formed of two pieces, i.e., upper and lower steel pieces 42A, 42B. The upper piece 42A forms the splines 46, the cylindrical surface 70, and upper sections 74A of the longitudinal passages 74, while the lower piece 42B forms the cutting face 44 and lower sections 74B of the longitudinal passages 74. The upper sections 74A are parallel to the exhaust passage, or inclined to the exhaust passage by up to five degrees.

Figure 3:
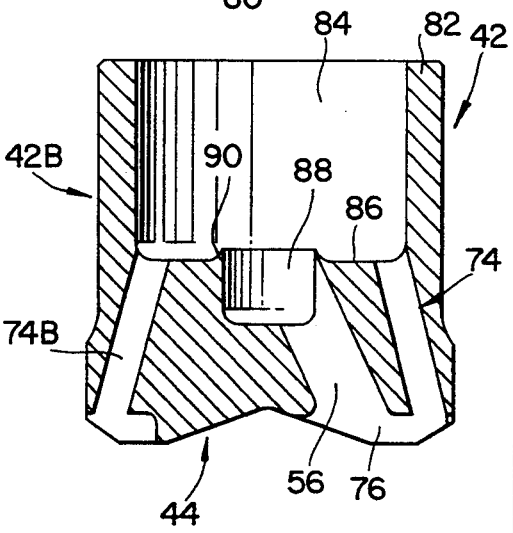
FIG. 3 is an exploded longitudinal sectional view of a drill bit of the drill taken along the line 3—3 in FIG. 2.

The lower piece 42B includes a cylindrical sleeve 82 forming a recess 84 into which the lower end of the upper piece 42A fits (see FIG. 3). The lower end of the recess 84 is formed by a bottom surface or floor 86 against which the lower end of the upper piece 42A abuts. That lower end of the upper piece 42A includes radial slots 80' which, together with the bottom surface 86, form the lateral passages 80.

Disposed at the center of the bottom surface 86 is a cavity 88 at which the exhaust holes 56 intersect. The cavity 88, which is aligned with the center passage 54, is bordered by an annular ridge 90 of the bottom surface 86. That ridge defines an upturned outlet end of each lateral passage 80 so that air which is discharged into the central passage 54 is directed upwardly in order to establish a venturi effect which aids in drawing cuttings upwardly through the exhaust holes 56. It will be appreciated that the inlets of all of the lateral passages 80 are interconnected by an annulus 81 defined between the lower end of the upper piece 42A and the upper end of the lower piece 42B. That annulus 81 is circular and communicates with all of the longitudinal passages.

The bit pieces 42A, 42B can be joined together in any suitable manner, such as by welding, shrink fit, adhesive bonding, mechanical fastening, etc.

By forming the drill bit 42 of pieces 42A, 42B which are secured together, the forming of the longitudinal and lateral passages 74, 80 is simplified. That is, the upper and lower sections 74A, 74B of the longitudinal passages are formed in the respective pieces 42A, 42B prior to the pieces being attached together. The slots 80' and the cavity 88 are also formed prior to attachment. The upper sections 74A of the passages 74 can be easily formed by a gun drilling operation, and are oriented parallel to the exhaust passage 54.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A down-the-hole hammer drill having a reverse circulation system, comprising:

a cylindrical case;

a driver sub mounted in said case;

a piston vertically reciprocally mounted in said case to be reciprocated by pressurized fluid; and a drill bit mounted in said driver sub beneath said piston for being impacted thereby, said drill bit connected to said driver sub for rotation therewith and being downwardly movable relative to said driver sub from a drilling condition to a drop-open condition, said drill bit including:

upper and lower pieces, said lower piece including a recess in which a lower end of said upper piece is fixedly interconnected, said recess including a floor and a side wall extending upwardly from said floor, a lower cutting face formed in said lower piece, a vertical internal exhaust passage extending upwardly from said cutting face to an upper end of said drill bit, said exhaust passage including a first passage portion formed in said lower piece and extending upwardly through said cutting face and said floor, and a second passage portion formed in said upper piece and extending to said upper end of said drill bit, said first passage portion extending through a central region of said floor, said central region spaced at a substantial distance below an uppermost end of said lower piece, said second passage portion having a lowermost end disposed adjacent an uppermost end of said first passage portion, said lowermost end of said second passage portion being formed in a downwardly facing end face of said upper piece which bears downwardly against said central region of said floor, a plurality of longitudinal passages spaced circumferentially around said exhaust passage, each longitudinal passage having upper and lower passage sections, said upper passage section formed in said upper piece and including an inlet, said lower passage section formed in said lower piece and extending to said cutting face, said longitudinal passages arranged to receive pressurized fluid and conduct that pressurized fluid to said cutting face and into said internal exhaust passage, each of said upper passage sections extending downwardly substantially to the lowermost end of said upper piece, said upper piece including a first radial thickness disposed between said exhaust passage and each of the longitudinal passages, and a second radial thickness disposed between each of the longitudinal passages and an outer surface of said upper piece, said first radial thickness being substantially greater than said second radial thickness, and said outer surface of said upper piece including an upper section disposed in guiding engagement with an inner surface of said driver sub in both said drilling condition and said drop-open condition, said outer surface including a lower section bearing against said side wall of said recess.

2. A hammer drill according to claim 1 including at least one lateral passage communicating a longitudinal passage with said inner exhaust passage at a location within said recess for discharging some of the pressurized fluid into said inner exhaust passage at a location within said recess for assisting in drawing fluid through said inner exhaust passage from said cutting face.

3. A hammer drill according to claim 2 including a plurality of said lateral passages having inlet ends which communicate with one another.

4. A hammer drill according to claim 2 wherein each lateral passage is formed partially by said upper piece and partially by said lower piece.

5. A hammer drill according to claim 4 wherein one of said downwardly facing end face and said floor including radial slots which, together with the other of said downwardly facing end face and said floor, form said lateral passages.

6. A hammer drill according to claim 5 wherein said radial slots are formed in said downwardly facing end face, said floor including an annular ridge at its center, said ridge arranged to surround a lower end of said inner passage when said upper and lower pieces are secured together, said ridge defining upturned outlets of said lateral passages for discharging fluid into said exhaust passage in an upward direction.

7. A down-the-hole hammer according to claim 2 wherein said lateral passage is defined by an interface between said central region of said floor and said downwardly facing end face of said upper piece.

8. A hammer drill according to claim 1 wherein said upper sections of said longitudinal passages are oriented substantially parallel to said exhaust passage.

9. A hammer drill according to claim 1, wherein said driver sub includes internal vertical splines, said upper piece including external vertical splines, said external splines meshing with said internal splines for transmitting torque from said driver sub to said drill bit while permitting relative vertical movement therebetween as said drill changes between said drilling condition and said drop-open condition, lower ends of said external splines being disposed above said cutting face, said inlets of said longitudinal passages being disposed generally adjacent said lower ends of said splines.

10. A hammer drill according to claim 1, wherein said outer surface of said upper piece and said inner surface of said driver sub are of circular cylindrical configuration.

11. A drill bit for a down-the-hole hammer with a reverse circulation system, comprising:

upper and lower pieces, said lower piece including a recess in which a lower end of said upper piece is fixedly interconnected, said recess including a floor and a side wall extending upwardly from said floor, a lower cutting face formed in said lower piece, a vertically extending inner fluid passage extending vertically from said cutting face to an upper end of said drill bit, said exhaust passage including a first passage portion formed in said lower piece and extending upwardly through said cutting face and said floor, and a second passage portion formed in said upper piece and extending to said upper end of said drill bit, said first passage portion extending through a central region of said floor, said central region spaced at a substantial distance below an uppermost end of said lower piece, said second passage portion having a lowermost end disposed adjacent an uppermost end of said first passage portion, said lowermost end of said second passage portion being formed in a downwardly facing end face of said upper piece which bears downwardly against said central region of said floor, a plurality of longitudinal passages spaced inwardly with respect to an outer periphery of said drill bit and outwardly relative to said exhaust passage, each longitudinal passage including upper and lower sections, said upper section formed in said upper piece and including an inlet, said lower section formed in said lower piece and extending downwardly to said cutting face, each of said upper passage sections extending downwardly substantially to the lowermost end of said upper piece, said upper piece including a first radial thickness disposed between said exhaust passage and each of the longitudinal passages, and a second radial thickness disposed between each of the longitudinal passages and an outer surface of said upper piece, said first radial thickness being substantially greater than said second radial thickness, and said outer surface of said upper piece including an upper section disposed in surrounding relationship to said upper sections of said longitudinal passages, and a lower section bearing against said side wall of said recess.

12. A drill bit according to claim 11 including at least one lateral passage communicating a longitudinal passage with said inner fluid passage at a location within said recess.

13. A drill bit according to claim 12 wherein said lateral passage is defined by an interface between said central region of said floor and said downwardly facing end face of said upper piece.

14. A drill bit according to claim 12 wherein there is a plurality of said lateral passages having inlet ends which communicate with one another.

15. A drill bit according to claim 12 wherein each lateral passage is formed partially by said upper piece and partially by said lower piece.

16. A drill bit according to claim 15 wherein one of said downwardly facing end face and said floor including radial slots which, together with the other of said downwardly facing end face and said floor, form said lateral passages.

17. A drill bit according to claim 16, wherein said radial slots are formed in said downwardly facing end face, said floor including an annular ridge at its center, said ridge arranged to surround a lower end of said inner fluid passage when said upper and lower pieces are secured together, said ridge defining upturned outlets of said lateral passages.

18. A drill bit according to claim 11 wherein said upper sections of said longitudinal passages are oriented substantially parallel to said exhaust passage.

19. A drill bit according to claim 11 including a plurality of vertically extending splines formed in said upper piece and arranged in circumferentially spaced relationship, lower ends of said splines being spaced above said cutting face, said inlets of said longitudinal passages being situated generally adjacent said lower ends of said splines.

20. A drill bit according to claim 11, wherein said outer surface of said upper piece is of circular cylindrical configuration.

21. A down-the-hole hammer drill having a reverse circulation system, comprising:

a cylindrical case;

a driver sub mounted in said case;

a piston vertically reciprocally mounted in said case to be reciprocated by pressurized fluid; and a drill bit mounted in said driver sub beneath said piston for being impacted thereby, said drill bit connected to said driver sub for rotation therewith and being downwardly movable relative to said driver sub from a drilling condition to a drop-open condition, said drill bit including:

upper and lower pieces, said lower piece including a recess in which a lower end of said upper piece is fixedly interconnected, a lower cutting face formed in said lower piece, a vertical internal exhaust passage formed in said upper piece in communication with said cutting face and extending upwardly to an upper end of said drill bit, a plurality of longitudinal passages each having upper and lower sections, said upper section formed in said upper piece and including an inlet, said lower section extending to said cutting face, said longitudinal passages arranged to receive pressurized fluid and conduct that pressurized fluid to said cutting face and into said internal exhaust passage, an outer surface formed on said upper piece in surrounding relationship to said upper sections of said longitudinal passages and being disposed in guiding engagement with an inner surface of said driver sub in both said drilling condition and said drop-open condition, and at least one lateral passage communicating a said longitudinal passage with said exhaust passage at a location within said recess, said lateral passage defined by an interface between said central region of said floor and said downwardly facing end face of said upper piece.

22. A drill bit for a down-the-hole hammer with a reverse circulation system, comprising:

upper and lower pieces, said lower piece including a recess in which a lower end of said upper piece is fixedly interconnected, a lower cutting face formed in said lower piece, a vertically extending inner fluid passage formed in said upper piece in communication with said cutting face and extending vertically to an upper end of said drill bit, a plurality of longitudinal passages spaced inwardly with respect to an outer periphery of said drill bit and outwardly relative to said exhaust passage, each longitudinal passage including upper and lower sections, said upper section formed in said upper piece and including an inlet, said lower section extending downwardly to aid cutting face, a cylindrical outer surface formed on said upper piece in surrounding relationship to said upper sections of said longitudinal passages, at least one lateral passage communicating a said longitudinal passage with said exhaust passage at a location within said recess, said lateral passage defined by an interface between a downwardly facing end face of said upper piece, and a floor of said recess.

* * * * *